United States Patent [19]

Lund

[11] 3,967,824

[45] July 6, 1976

[54] GAME BOARD UNIT

[76] Inventor: William J. Lund, 1869 Carmel Ave., Stockton, Calif. 95204

[22] Filed: May 22, 1975

[21] Appl. No.: 579,773

[52] U.S. Cl. ..... 273/110; 273/1 M

[51] Int. Cl.[2] ..... A63F 7/04

[58] Field of Search ..... 273/110, 109, 113, 115, 273/116, 1 M

[56] References Cited

UNITED STATES PATENTS

| | | | |
|---|---|---|---|
| 577,730 | 2/1897 | Eberhardt | 273/1 M UX |
| 778,382 | 12/1904 | Stone | 273/1 M UX |
| 857,411 | 6/1907 | Moseley | 273/113 |
| 1,384,057 | 7/1921 | Fleet | 273/115 |
| 3,462,148 | 8/1969 | Fors | 273/116 |

FOREIGN PATENTS OR APPLICATIONS

| | | | |
|---|---|---|---|
| 958,117 | 9/1949 | France | 273/110 |
| 1,081,381 | 6/1954 | France | 273/110 |
| 451,220 | 7/1936 | United Kingdom | 273/110 |

*Primary Examiner*—Anton O. Oechsle
*Attorney, Agent, or Firm*—Roger B. Webster

[57] ABSTRACT

A game board unit comprising a flat, upwardly facing game board of non-magnetic material mounted for substantially universal tilting motion under manual control of a player, a multiplicity of board-mounted elements defining and bordering a circuitous path on the face of the board between a starting point and a finish point thereon, certain of such elements being magnets, and a magnetically-responsive ball adapted to run along such path between said points in response to variable tilting of the board by the player and in a manner attempting to maintain the running ball free of the attraction of and adhesion to said magnets.

5 Claims, 2 Drawing Figures

GAME BOARD UNIT

BACKGROUND OF THE INVENTION

Parlor games requiring manipulative skill are known in sundry forms, but many are of such design that the desired end can be too easily accomplished. The present invention was conceived by me in a successful effort to provide a game board unit which--to operate in a manner to "win"--requires substantial concentration and deft manual skill.

SUMMARY OF THE INVENTION

The present invention provides, as a major object, a game board unit which embodies a manually tiltable game board having a path defined thereon, and magnets on the board adjacent such path; there being a magnetically-responsive ball adapted to be run along such path by tilting of the board, and the objective being to maintain the running ball on the path out of range of the attraction and adhesive effect of the magnets.

The present invention provides, as another important object, a game board unit--as in the preceding paragraph—which, more particularly, comprises a flat, upwardly facing game board of non-magnetic material mounted for substantially universal tilting motion under manual control of a player, a multiplicity of board-mounted elements defining and bordering a circuitous path on the face of the board between a starting point and a finish point thereon, certain of such elements being magnets, and a magnetically-responsive ball adapted to run along such path between said points in response to variable tilting of the board by the player and in a manner attempting to maintain the running ball free of the attraction of and adhesion to said magnets.

The present invention provides, as a further object, a game board unit which is designed for ease and economy of manufacture.

The present invention provides, as a still further object, a practical, reliable, and durable game board unit, and one which is exceedingly effective for the purpose for which it is designed.

DESCRIPTION OF THE PREFERRED EMBODIMENT

Figure 1:
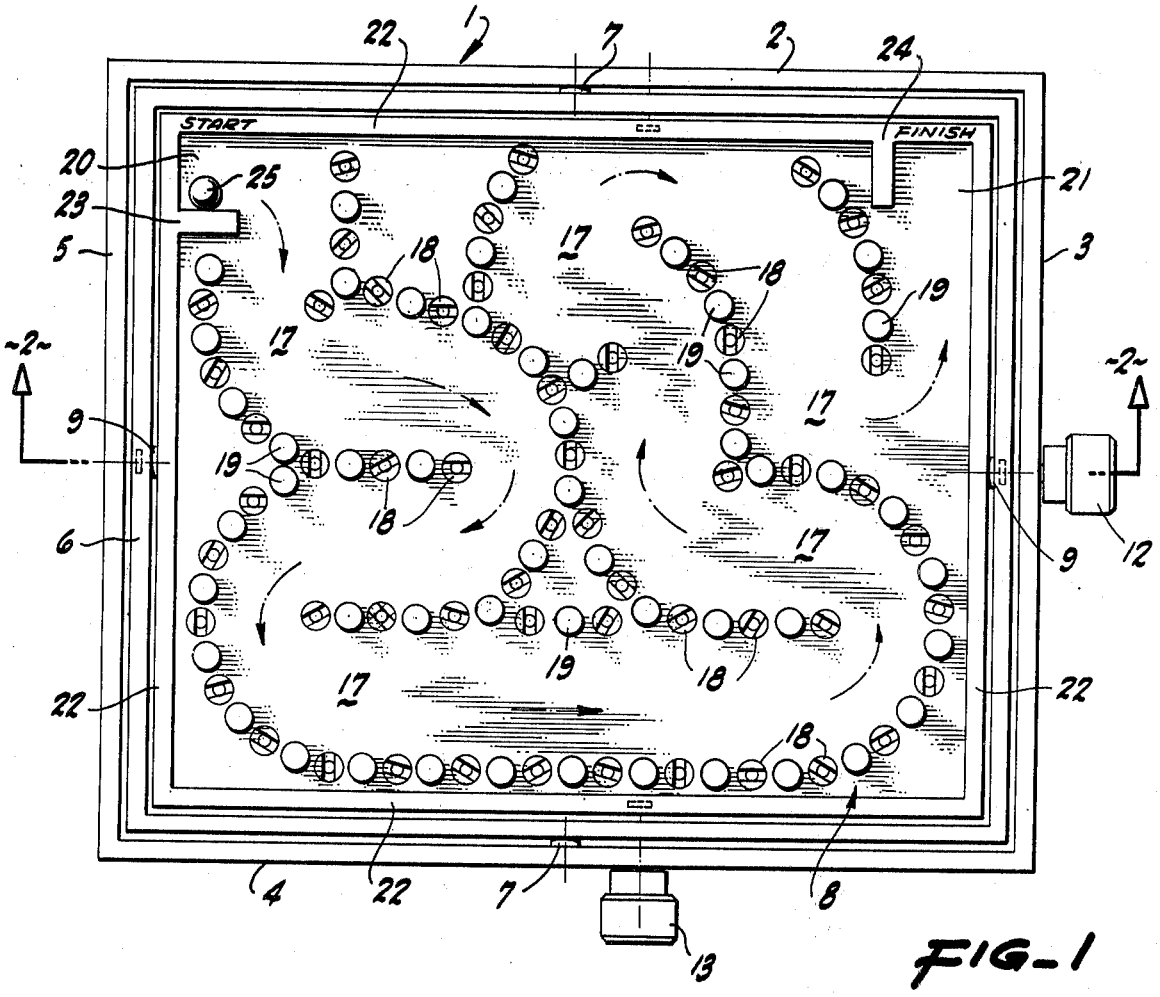
FIG. 1 is a plan view of the game board unit.
Figure 2:
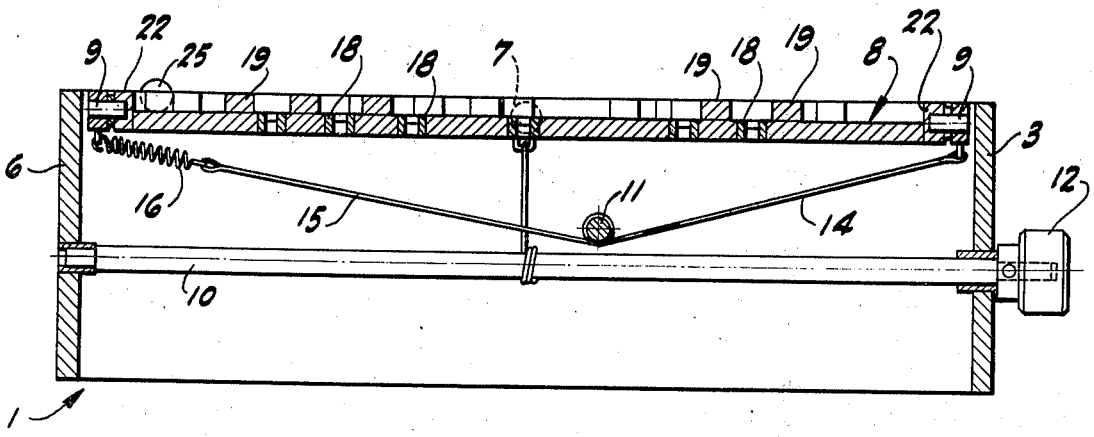
FIG. 2 is a vertical sectional elevation taken substantially on line 2—2 of FIG. 1.

Referring now more particularly to the drawings and to the characters of reference marked thereon, the game board unit comprises a rectangular, upstanding, open-top, main supporting frame indicated generally at 1; such frame including four sides identified by the reference numerals 2, 3, 4, and 5.

Within the confines of the upper portion thereof, the frame 1 surrounds a tiltable carrier frame 6; such carrier frame being open, rectangular, and symmetrical to, but peripherally spaced from said frame 1.

Axially alined trunnions 7--disposed centrally on opposite sides of the carrier frame 6--extend in journaled relation between said opposite sides of the carrier frame and the corresponding sides 2 and 4 of the main frame 1 whereby the carrier frame is tiltable about the axis of said trunnions 7.

Within the confines thereof, the open carrier frame 6 surrounds an upwardly facing, tiltable game board 8; such game board--of a non-magnetic material such as plastic—being rectangular and symmetrical to but peripherally spaced from said carrier frame 6.

Axially alined trunnions 9--disposed centrally on opposite sides of the game board 8, and in a vertical plane at a right angle to the vertical plane of alined trunnions 7—extend in journaled relation between such opposite sides of the game board and the corresponding sides of the carrier frame 6 whereby said game board is tiltable about the axis of said trunnions 9.

The carrier frame 6, the alined trunnions 7, and—in a right angle plane--the alined trunnions 9, provide a somewhat gimbal-like mount for the game board 8 and permit of substantially universal tilting thereof relative to horizontal, and which tilting is selectively and variably accomplished as follows:

Below the game board 8, a cross shaft 10 spans between and is journaled in the main frame sides 3 and 5 intermediate their ends, while another cross shaft 11 spans--at a right angle to cross shaft 10--between and is journaled in the main frame sides 2 and 4 intermediate their ends; the shafts intersecting within frame 1 in adjacent but clearance relation. One end of each of the shafts 10 and 11 projects out of the main frame 1, and at the outer and exposed end each such shaft is fitted with an operating knob; the knobs correspond to said shafts 10 and 11 being indicated at 12 and 13, respectively.

A flexible cord 14 is wound, intermediate its ends in windlass fashion, about cross shaft 11, and thence extends in opposite radial directions to connection with opposite sides of the carrier frame 6, while another right-angularly disposed flexible cord 15 is similarly wound intermediate its ends about cross shaft 10, and thence extends in opposite radial directions to connection with opposite sides of the game board 8. Thus, upon rotation of cross shaft 11 by knob 13, the carrier frame 6 is tilted about trunnions 7; and upon rotation of cross shaft 10 by knob 12, the game board is tilted about trunnions 9. With this arrangement, a player simultaneously grasping the individual knobs with corresponding hands can effect selective and substantially universal tilting motion of the game board 8.

In order to maintain the flexible cords 14 and 15 taut, each may include a tension spring; one being shown, in cord 15, at 16.

A multiplicity of board-mounted elements define and border a circuitous path 17 on the game board 8; such elements being cylindrical, plug-type, flush-mounted magnets 18 and upstanding, non-magnetic pins 19 in alternate array along the margins of said path 17.

The path 17 extends from a ball-release starting pocket 20 to a ball-receiving finish pocket 21 on the board; the latter having an upstanding peripheral curb 22, and such pockets being formed at corners of the board by short upstanding walls 23 and 24, respectively.

The path 17, as defined and bordered by the alternately disposed magnets 18 and pins 19 is of varying width but always wide enough so that a metallic, magnetically-responsive ball 25 can--if run generally midway between the margins or borders of such path--travel along the path without hindrance by the magnets. This, therefore, is the objective of the game; the concentration and skill of the person operating the game board unit (by tilting the board 8) determining whether the ball can be run from start to finish, on the circuitous path 17, without being magnetically trapped by one of the magnets 18. More particularly, the pins 19 are spaced apart a distance such that the ball 25--if it deviates, in its travel along the path 17, into the field of magnetic attraction of one of the magnets 18--can pass to a position between adjacent pins 19 and seat on such magnet. This, of course, constitutes a "foul", terminates the run, and is counted against the player; each player, under the preferred rules, being permitted a predetermined number of runs of the ball out of the starting pocket 20.

From the foregoing description, it will be readily seen that there has been produced such a game board unit as substantially fulfills the objects of the invention, as set forth herein.

While this specification sets forth in detail the present and preferred construction of the game board unit, still in practice such deviations from such detail may be resorted to as do not form a departure from the spirit of the invention as defined by the appended claims.

I claim:

1. A game board unit comprising an upwardly facing game board of non-magnetic material, means supporting the game board for substantially universal tilting under manual control of a player, a multiplicity of board-mounted elements defining and bordering a circuitous path on the face of the game board between a starting point and a finish, certain of said elements being magnets, and a magnetically-responsive ball adapted to be run along such path between said points in response to variable tilting by the player of the game board and in a manner attempting to maintain the running ball free of the attraction of and adhesion to said magnets; the magnets being spaced apart along the borders of said path, there being a pin upstanding from the board between adjacent magnets, and such pins being of non-magnetic material.

2. A game board unit, as in claim 1, in which the pins adjacent each magnet are spaced apart a distance such that the ball, under the magnetic attraction of said magnet, can, without obstruction, seat thereon.

3. A game board unit comprising an upwardly facing game board of non-magnetic material, means supporting the game board for substantially universal tilting under manual control of a player, a multiplicity of board-mounted elements defining and bordering a circuitous path on the face of the game board between a starting point and a finish, certain of said elements being magnets, and a magnetically-responsive ball adapted to be run along such path between said points in response to variable tilting by the player of the game board and in a manner attempting to maintain the running ball free of the attraction of and adhesion to said magnets; said board-mounted elements comprising, in alteration, flush-mounted magnets and upstanding non-magnetic pins.

4. A game board unit, as in claim 3, in which the pins adjacent each magnet are spaced apart a distance such that the ball, under the magnetic attraction of said magnet, can, without obstruction, seat thereon.

5. In a game board which embodies an upwardly facing, player-manipulated, universally tiltable game board, means on the game board forming a circuitous path on the face thereof between a starting point and a finish point, and a ball adapted to be run along said path between such points in response to variable tilting by the player of the game board in a manner attempting to maintain the running ball on said path intermediate its margins; the improvement characterized by the game board being of non-metallic material, the ball being of magnetically-responsive material, and said path-forming means including a multiplicity of board-mounted elements which for substantially the length thereof define and magnetically border both sides of such path, and said elements being a multiplicity of magnets in rows wherein the magnets are disposed in relatively close but spaced relation.

* * * * *